US009851647B1

(12) United States Patent
Wu et al.

(10) Patent No.: US 9,851,647 B1
(45) Date of Patent: Dec. 26, 2017

(54) POLYCARBONATE CONTAINING PHOTOCONDUCTORS

(71) Applicant: Xerox Corporation, Norwalk, CT (US)

(72) Inventors: Jin Wu, Pittsford, NY (US); Kenny-Tuan Dinh, Webster, NY (US); Lanhui Zhang, Webster, NY (US); Jimmy E. Kelly, Rochester, NY (US); Mark S. Thomas, Williamson, NY (US); Min-Hong Fu, Webster, NY (US); Lin Ma, Pittsford, NY (US); Markus R. Silvestri, Fairport, NY (US); Marc J. LiVecchi, Rochester, NY (US); Robert W. Hedrick, Spencerport, NY (US); Linda L. Ferrarese, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 15/292,931

(22) Filed: Oct. 13, 2016

(51) Int. Cl.
*G03G 5/05* (2006.01)
*G03G 5/047* (2006.01)
*G03G 5/07* (2006.01)
*G03G 5/06* (2006.01)

(52) U.S. Cl.
CPC ..... *G03G 5/047* (2013.01); *G03G 5/0609* (2013.01); *G03G 5/0614* (2013.01); *G03G 5/0696* (2013.01); *G03G 5/075* (2013.01)

(58) Field of Classification Search
CPC ..... G03G 5/0564
See application file for complete search history.

(56) References Cited

U.S. PATENT DOCUMENTS

2015/0024310 A1* 1/2015 Yu ..... G03G 5/0564 430/56
2015/0056546 A1* 2/2015 Yu ..... G03G 5/047 430/56

* cited by examiner

*Primary Examiner* — Hoa V Le
(74) *Attorney, Agent, or Firm* — Eugene O. Palazzo

(57) ABSTRACT

A photoconductor that includes, for example, a supporting substrate, an optional ground plane layer, an optional hole blocking layer, an optional adhesive layer, a photogenerating layer, and a charge transport layer, and where the charge transport layer contains a mixture of a charge transport component and a polycarbonate AP.

23 Claims, 1 Drawing Sheet

POLYCARBONATE CONTAINING PHOTOCONDUCTORS

Disclosed herein are photoconductors comprised of a photogenerating layer and a charge transport layer comprised of a charge transport component and a polycarbonate AP of, for example, the structures/formulas illustrated herein.

BACKGROUND

Photoconductors that include photogenerating layers and specific charge transport layers are known. Although these photoconductors may be useful for xerographic imaging and printing systems. many of them have a tendency to deteriorate and thus have to be replaced at considerable costs and with extensive resources. A number of known photoconductors also have a minimum of, or a lack of resistance to abrasion from dust, charging rolls, toner, and carrier. For example, the surface layers of photoconductors are subject to scratches, which decrease their lifetime, and in xerographic imaging systems adversely affect the quality of the developed images. While used photoconductor components can be partially recycled, there continues to be added costs and potential environmental hazards when recycling.

In xerographic systems extending photoreceptor life using robust layers, such as overcoats, can in some instances cause undesirable increased lateral charge migration (LCM) due to lowered wear rates and accumulation of polar and conductive chemical species on the photoconductor and friction between the cleaning blade and the photoconductor surface. Increased friction is particularly pronounced in BCR (biased charging roll) charging systems where friction forces become excessive in that the torque provided by the photoconductor motor is insufficient to even turn the photoconductor drum resulting in a torque failure thereby rendering the xerographic system and machine inoperable. Under these circumstances, the cleaning blade chips and deforms to an extent where it is non-functional and causes cleaning streaks in the xerographic developed electrostatic images.

In addition, imaging members, such as photoconductors, are generally exposed to repetitive xerographic cycling, which subjects the exposed charged transport layer or alternative top overcoat layer thereof to mechanical abrasion, chemical attack and heat. This repetitive cycling causes gradual deterioration in the mechanical and electrical characteristics of the exposed photoconductor surface layer. Physical and mechanical damage during prolonged use, including the formation of surface scratch defects, are examples of reasons for the failure of belt photoconductors.

Thus, there is a need for photoconductors that substantially avoid or minimize the disadvantages of a number of known photoconductors.

Also, there is a need for wear resistant photoconductors with excellent, or acceptable mechanical characteristics, especially in xerographic systems where biased charging rolls (BCR) are used.

There is also a need to improve the mechanical robustness of photoconductors or photoreceptors, and to increase their scratch resistance, thereby prolonging their service life.

Moreover, there is a need for abrasion scratch resistant photoconductive surface layers with, for example, from about 10 percent to about 25 percent wear reduction improvement.

There also remains a need for improved imaging members that are wear resistant, and that provide in combination excellent imaging performance, extended lifetimes, and that possess reduced human and environmental health risks.

Wear resistant long life photoconductors with excellent cyclic characteristics and stable electrical properties, stable long term cycling, minimal charge deficient spots (CDS), and acceptable lateral charge migration (LCM) characteristics, such as excellent LCM resistance, are also desirable needs.

These and other needs are believed to be achievable with the photoconductors disclosed herein.

SUMMARY

Disclosed is a photoconductor comprising a photogenerating layer, and a charge transport layer, and wherein said charge transport layer contains a charge transport compound, and a polycarbonate as represented by the following formula/structure

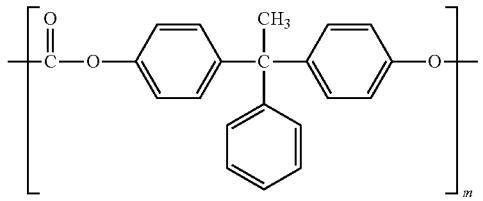

wherein m represents the number of repeating segments or groups.

Also disclosed is a photoconductor comprised in sequence of a supporting substrate, a hole blocking layer thereover, a photogenerating layer, and a charge transport layer comprised of a mixture of an aryl amine hole transport compound, an antioxidant, a fluoropolymer, and a polycarbonate as represented by the following formula/structure

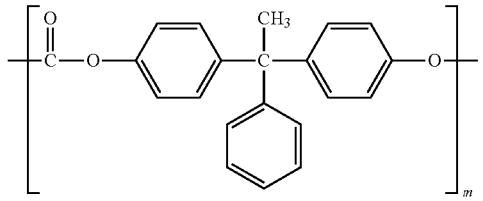

wherein m represents the number of repeating segments or groups.

Further there is disclosed a photoconductor comprising a supporting substrate, a hole blocking layer thereover, a photogenerating layer, and a hole transport layer comprised of a mixture of a hole transport compound, an optional fluoropolymer, an optional antioxidant, and a polycarbonate as encompassed by the following formula/structure, and which photoconductor possesses a wear rate reduction of from about 10 percent to about 25 percent

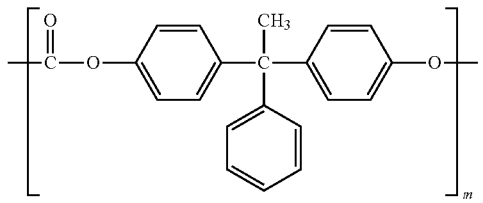

wherein m represents the number of repeating segments or groups.

Yet additionally disclosed is a photoconductor comprising a charge transport layer comprised of a mixture of an aryl amine charge transport component, a fluoropolymer, an antioxidant, and a polycarbonate as encompassed by the following formula/structure

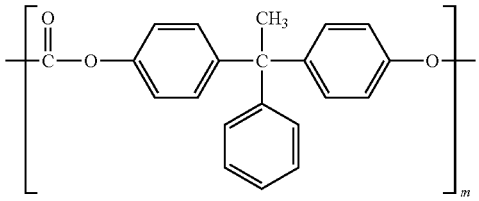

wherein m represents the number of repeating segments or groups.

FIGURES

There are provided the following Figures to further illustrate the photoconductors disclosed herein.

EMBODIMENTS

In embodiments of the present disclosure, there is illustrated a photoconductor comprising an optional supporting substrate, a photogenerating layer, and a polycarbonate AP containing charge transport layer.

Figure 1:
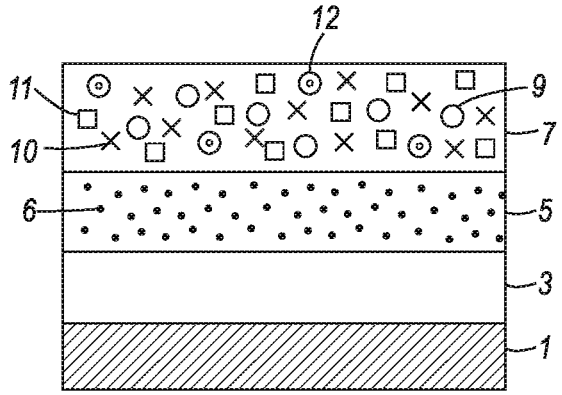
FIG. 1 illustrates an exemplary embodiment of a layered photoconductor of the present disclosure.
Figure 2:
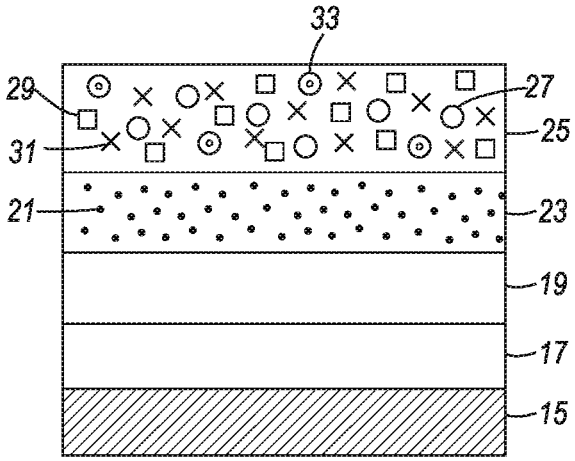
FIG. 2 illustrates an exemplary embodiment of another layered photoconductor of the present disclosure.

Exemplary and non-limiting examples of photoconductors according to embodiments of the present disclosure are depicted in FIGS. 1 and 2.

In FIG. 1, there is illustrated a photoconductor comprising an optional supporting substrate layer 1, an optional hole blocking layer 3, a photogenerating layer 5 containing photogenerating pigments 6, and a charge transport layer 7 containing a mixture of charge transport compounds 9, polycarbonate APs 10, optional fluoropolymers 11, and optional antioxidants 12.

In FIG. 2, there is illustrated a photoconductor comprising an optional supporting substrate layer 15, an optional hole blocking layer 17, an optional adhesive layer 19, a photogenerating layer 23 containing inorganic or organic photogenerating pigments 21, and a charge transport layer 25 containing charge transport compounds 27, polycarbonate APs 29, antioxidants 31, and fluoropolymers 33.

Polycarbonate APs

Various polycarbonate APs resulting, for example, from the polymerization of bisphenol AP, and phosgene, and referred to, for example, as poly(4,4'-(1-phenylethylidene) bisphenol carbonate), can be selected for inclusion in the photoconductor charge transport layer or layers of the present disclosure.

In embodiments of the present disclosure, the polycarbonate AP can be prepared in accordance with the following reaction scheme

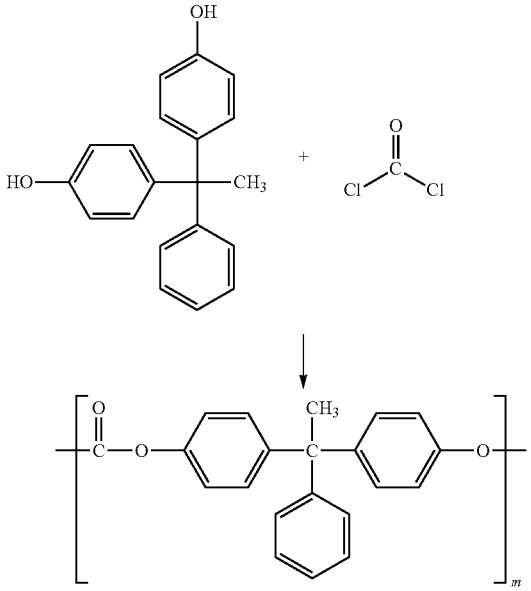

where m represents the number of repeating groups or segments.

Examples of polycarbonate APs, available from Mitsubishi Gas Chemical Company, such as those designated as FPC-0250, and selected for the charge transport layer are represented by the following formula/structure

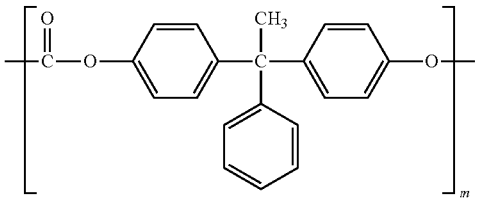

wherein m represents the number of repeating segments or groups of, for example, from about 50 to about 500, from about 75 to about 300, from about 100 to about 225, or from about 125 to about 200, with the weight average molecular weight as determined by Gel Permeation Chromatography (GPC analysis) being, for example, from about 10,000 to about 100,000, or from about 30,000 to about 70,000.

In the charge transport layer mixture, the polycarbonate APs illustrated herein can be present in a number of effective amounts, such as for example, from about 40 to about 85 weight percent, from about 50 to about 75 weight percent, from about 55 to about 65 weight percent, or from about 60 to about 63 weight percent, based on the total solids.

Photoconductor Layer Examples

A number of known components can be selected for the various photoconductor layers, such as the supporting substrate when present, the photogenerating layer, the charge transport layer mixture, the ground plane layer when present, the hole blocking layer when present, and the adhesive layer when present.

Optional Supporting Substrates

The thickness of the photoconductor optional supporting substrate layer depends on many factors, including economical considerations, the electrical characteristics desired, flexibility, availability, strength, and cost of the specific components for each layer, and the like, thus this layer may be of a substantial thickness of, for example, from about 2,500 microns, such as from about 50 to about 2,000 microns, from about 400 to about 1,000 microns, or from about 200 to about 600 microns ("about" throughout includes all values in between the values recited), or of a minimum thickness. In embodiments, the thickness of this layer is from about 70 to about 300 microns, or from about 100 to about 175 microns.

More specifically, for a photoconductor drum configuration the supporting substrate layer may be of a thickness of, for example, up to many centimeters or of a minimum thickness of less than a millimeter. When the photoconductor is in the configuration of a flexible belt, the supporting substrate may be of a thickness of, for example, about 250 microns, or of a minimum thickness of less than about 50 microns provided there are no adverse effects on the final electrophotographic device.

The photoconductor substrate may be opaque or substantially transparent, and may comprise any suitable material including known or future developed materials. Accordingly, the substrate may comprise a layer of an electrically nonconductive or conductive material such as an inorganic or an organic composition. As electrically non-conducting materials, there may be employed various resins known for this purpose including polyesters, polycarbonates, polyamides, polyurethanes, and the like, which are flexible in the form of thin webs.

The disclosed electrically conducting substrate may include any suitable metal of, for example, aluminum, nickel, steel, copper, gold, and the like, or a polymeric material, filled with an electrically conducting substance, such as carbon, metallic powder, and the like, or an organic electrically conducting material. The electrically insulating or conductive substrate may be in the form of an endless flexible belt, a web, a rigid cylinder, a sheet, and the like. In embodiments where the substrate layer is not conductive, the surface thereof may be rendered electrically conductive by an electrically conductive coating. The conductive coating may vary in thickness over substantially wide ranges depending upon the optical transparency thereof, the degree of flexibility desired, and economic factors.

Illustrative examples of substrates are as illustrated herein, and more specifically, supporting substrate layers selected for the photoconductors of the present disclosure comprise a layer of insulating material including inorganic or organic polymeric materials, such as MYLAR® a commercially available polymer, MYLAR® containing titanium, a layer of an organic or inorganic material having a semiconductive surface layer, such as indium tin oxide, or aluminum arranged thereon, or a conductive material inclusive of aluminum, chromium, nickel, brass, and the like. The substrate may be flexible, seamless, or rigid, and may have a number of many different configurations, such as for example, a plate, a cylindrical drum, a scroll, an endless flexible belt, and the like. In embodiments, the substrate is in the form of a seamless flexible belt. In some situations, it may be desirable to coat on the back of the substrate, particularly when the substrate is a flexible organic polymeric material, an anticurl layer, such as for example, polycarbonates commercially available as MAKROLON®.

Optional Anticurl Layer

In some situations, it may be desirable to provide a known anticurl layer on the back of the photoconductor substrate, particularly when the substrate is comprised of a flexible organic polymeric material. This anticurl layer, which is sometimes referred to as an anticurl backing layer, minimizes undesirable curling of the substrate. Suitable materials selected for the disclosed photoconductor anticurl layer include, for example, polycarbonates commercially available as MAKROLON®, polyesters, and the like. The anticurl layer can be of a thickness of, for example, from about 5 to about 40 microns, from about 10 to about 30 microns, or from about 15 to about 25 microns.

Optional Ground Plane Layer

Positioned on the top side of the supporting substrate there can be included an optional ground plane such as gold, gold containing compounds, aluminum, titanium, titanium/zirconium, and other suitable known components. The thickness of the ground plane layer can be from about 10 to about 100 nanometers, from about 20 to about 50 nanometers, from about 10 to about 30 nanometers, from about 15 to about 25 nanometers, or from about 20 to about 35 nanometers.

Optional Hole-Blocking Layer

An optional charge blocking layer or hole blocking layer may be applied to the photoconductor supporting substrate, such as an electrically conductive supporting substrate surface prior to the application of a photogenerating layer. An optional hole blocking layer, when present, is usually in contact with the ground plane layer, and also can be in contact with the supporting substrate. The hole blocking layer generally comprises any of a number of suitable known components as illustrated herein, such as metal oxides, phenolic resins, aminosilanes, and the like, and mixtures thereof. The hole blocking layer can have a thickness of, for example, from about 0.01 to about 30 microns, from about 0.02 to about 5 microns, or from about 0.03 to about 2 microns.

Examples of hole blocking layer aminosilanes can be represented by the following formula/structure

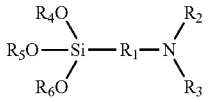

wherein $R_1$ is alkylene, straight chain or branched containing, for example, from 1 to about 25 carbon atoms, from 1 to about 18 carbon atoms, from 1 to about 12 carbon atoms, or from 1 to about 6 carbon atoms; $R_2$ and $R_3$ are, for example, independently selected from the group consisting of at least one of a hydrogen atom, alkyl containing, for example, from 1 to about 12 carbon atoms, from 1 to about 10 carbon atoms, or from 1 to about 4 carbon atoms; aryl containing, for example, from about 6 to about 24 carbon atoms, from about 6 to about 18 carbon atoms, or from about 6 to about 12 carbon atoms, such as a phenyl group, and a poly(alkylene amino) group, such as a poly(ethylene amino) group, and where $R_4$, $R_5$ and $R_6$ are independently an alkyl group containing, for example, from 1 to about 12 carbon atoms, from 1 to about 10 carbon atoms, or from 1 to about 4 carbon atoms.

Specific examples of suitable hole blocking layer aminosilanes include 3-aminopropyl triethoxysilane, N, N-dimethyl-3-aminopropyl triethoxysilane, N-phenylaminopropyl trimethoxysilane, triethoxysilylpropylethylene diamine, trimethoxysilylpropylethylene diamine, trimethoxysilylpropyldiethylene triamine, N-aminoethyl-3-aminopropyl trimethoxysilane, N-2-aminoethyl-3-aminopropyl trimethoxysilane, N-2-aminoethyl-3-aminopropyl tris(ethylethoxy)silane, p-aminophenyl trimethoxysilane, N,N'-dimethyl-3-aminopropyl triethoxysilane, 3-aminopropylmethyl diethoxysilane, 3-aminopropyl trimethoxysilane, N-methylaminopropyl triethoxysilane, methyl[2-(3-trimethoxysilylpropylamino) ethylamino]-3-proprionate, (N,N'-dimethyl 3-amino)propyl triethoxysilane, N,N-dimethylaminophenyl triethoxysilane, trimethoxysilyl propyldiethylene triamine, and the like, and mixtures thereof. Specific aminosilanes incorporated into the hole blocking layer are 3-aminopropyl triethoxysilane (γ-APS), N-aminoethyl-3-aminopropyl trimethoxysilane, (N,N'-dimethyl-3-amino)propyl triethoxysilane, or mixtures thereof.

The hole blocking layer aminosilane may be treated to form a hydrolyzed silane solution before being added into the final hole blocking layer coating solution or dispersion. During hydrolysis of the aminosilanes, the hydrolyzable groups, such as the alkoxy groups, are replaced with hydroxyl groups. The pH of the hydrolyzed silane solution can be controlled to be from about 4 to about 10, or from about 7 to about 8 to thereby result in photoconductor electrical stability. Control of the pH of the hydrolyzed silane solution may be affected with any suitable material, such as generally organic acids or inorganic acids. Examples of organic and inorganic acids selected for pH control include acetic acid, citric acid, formic acid, hydrogen iodide, phosphoric acid, hydrofluorosilicic acid, p-toluene sulfonic acid, and the like.

The hole blocking layer can, in embodiments, be prepared by a number of known methods, the process parameters being dependent, for example, on the photoconductor member desired. The hole blocking layer can be coated as a solution or as a dispersion onto the photoconductor supporting substrate, or the hole blocking layer can be coated on the ground plane layer by the use of a spray coater, a dip coater, an extrusion coater, a roller coater, a wire-bar coater, a slot coater, a doctor blade coater, a gravure coater, and the like, and dried at, for example, to from about 40° C. to about 200° C. or from 75° C. to 150° C. for a suitable period of time, such as for example, from about 1 to about 4 hours, from about 1 to about 10 hours, or from about 40 to about 100 minutes in the presence of an air flow. The hole blocking layer coating can be accomplished in a manner to provide a final hole blocking layer thickness after drying of, for example, from about 0.01 to about 30 microns, from about 0.02 to about 5 microns, or from about 0.03 to about 2 microns.

Optional Adhesive Layer

An optional adhesive layer may be included between the photoconductor hole blocking layer and the photogenerating layer. Typical adhesive layer materials selected for the photoconductors illustrated herein include polyesters, polyurethanes, copolyesters, polyamides, poly(vinyl butyrals), poly(vinyl alcohols), polyacrylonitriles, and the like, and mixtures thereof. The adhesive layer thickness can be, for example, from about 0.001 micron to about 1 micron, from about 0.05 to about 0.5 micron, or from about 0.1 to about 0.3 micron. Optionally, the adhesive layer may contain effective suitable amounts of, for example, from about 1 to about 10 weight percent, or from about 1 to about 5 weight percent of conductive particles, such as zinc oxide, titanium dioxide, silicon nitride, and carbon black; nonconductive particles, such as polyester polymers, and mixtures thereof.

Photogenerating Layer

Usually, the disclosed photoconductor photogenerating layer is applied by vacuum deposition or by spray drying onto the supporting substrate, and a charge transport layer or plurality of charge transport layers are formed on the photogenerating layer. The charge transport layer may be situated on the photogenerating layer, the photogenerating layer may be situated on the charge transport layer, or when more than one charge transport layer is present, each of these layers can be contained on the photogenerating layer or layers between the photogenerating layer and charge transport layer. Also, the photogenerating layer may be applied to layers that are situated between the supporting substrate and the charge transport layer.

Generally, the photogenerating layer can contain known photogenerating pigments, such as metal phthalocyanines, metal free phthalocyanines, alkylhydroxyl gallium phthalocyanines, hydroxygallium phthalocyanines, halogallium phthalocyanines, such as chlorogallium phthalocyanines, perylenes, such as bis(benzimidazo)perylene, titanyl phthalocyanines, especially Type V titanyl phthalocyanine, and the like, and mixtures thereof.

Examples of photogenerating pigments included in the photogenerating layer are vanadyl phthalocyanines, hydroxygallium phthalocyanines, such as Type V hydroxygallium phthalocyanines, Type C hydroxygallium phthalocyanines, high sensitivity titanyl phthalocyanines, Type IV and V titanyl phthalocyanines, quinacridones, polycyclic pigments, such as dibromo anthanthrone pigments, perinone diamines, polynuclear aromatic quinones, azo pigments including bis-, tris- and tetrakis-azos, and the like, and other known photogenerating pigments; inorganic components, such as selenium, selenium alloys, and trigonal selenium; and pigments of crystalline selenium and its alloys.

The photogenerating component, such as a pigment, can be dispersed in a resin binder or alternatively no resin binder need be present. For example, the photogenerating pigments can be present in an optional resinous binder composition in various amounts inclusive of up to about 99.5 to 100 weight percent by weight based on the total solids of the photogenerating layer. Generally, from about 5 to about 95 percent by volume of the photogenerating pigment is dispersed in about 95 to about 5 percent by volume of a resinous binder, or from about 20 to about 30 percent by volume of the photogenerating pigment is dispersed in about 70 to about 80 percent by volume of the resinous binder composition. In one embodiment, about 90 percent by volume of the photogenerating pigment is dispersed in about 10 percent by volume of the resinous binder composition.

Examples of polymeric binder materials that can be selected as the matrix or binder for the disclosed photogenerating layer pigments include thermoplastic and thermosetting resins, such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, poly(phenylene sulfides), poly(vinyl acetate), polysiloxanes, polyacrylates, polyvinyl acetals, polyamides, polyimides, amino resins, phenylene oxide resins, terephthalic acid resins, phenoxy resins, epoxy resins, phenolic resins, polystyrene, acrylonitrile copolymers, poly (vinyl chloride), vinyl chloride and vinyl acetate copolymers, acrylate copolymers, alkyd resins, cellulosic film formers, poly(amideimide), styrene butadiene copolymers, vinylidene chloride-vinyl chloride copolymers, vinyl acetate-vinylidene chloride copolymers, styrene-alkyd resins, poly(vinyl carbazole), and the like, inclusive of block, random, or alternating copolymers thereof.

It is often desirable to select a coating solvent for the preparation of disclosed photogenerating layer mixture, and which solvent does not substantially disturb or adversely affect the previously coated layers of the photoconductor. Examples of coating solvents used for the photogenerating layer coating mixture include ketones, alcohols, aromatic hydrocarbons, halogenated aliphatic hydrocarbons, ethers, amines, amides, esters, and the like, and mixtures thereof. Specific solvent examples selected for the photogenerating mixture are cyclohexanone, acetone, methyl ethyl ketone, methanol, ethanol, butanol, amyl alcohol, toluene, xylene, chlorobenzene, carbon tetrachloride, chloroform, methylene chloride, trichloroethylene, tetrahydrofuran, dioxane, diethyl ether, dimethyl formamide, dimethyl acetamide, butyl acetate, ethyl acetate, methoxyethyl acetate, and the like.

The photogenerating layer can be of a thickness of, for example, from about 0.01 to about 10 microns, from about 0.05 to about 10 microns, from about 0.2 to about 2 microns, or from about 0.25 to about 1 micron.

Charge Transport Layer

The disclosed charge transport layer or layers, and more specifically, in embodiments, a first or bottom charge transport layer in contact with the photogenerating layer, and over the first or bottom charge transport layer a top or second charge transport overcoating layer, comprises charge transporting compounds or molecules dissolved, or molecularly dispersed in the polycarbonate APs disclosed herein. In embodiments, "dissolved" refers, for example, to forming a solution in which the charge transport molecules are dissolved in the polycarbonate AP to form a homogeneous phase; and molecularly dispersed refers, for example, to charge transporting molecules or compounds dispersed on a molecular scale in the polycarbonate AP.

In embodiments, charge transport refers, for example, to charge transporting molecules that allows the free charge generated in the photogenerating layer to be transported across the charge transport layer. The charge transport layer is usually substantially nonabsorbing to visible light or radiation in the region of intended use, but it is electrically active in that it allows the injection of photogenerated holes from the photoconductive layer or photogenerating layer, and permits these holes to be transported to selectively discharge surface charges present on the surface of the photoconductor.

A number of charge transport compounds can be included in the charge transport layer mixture or in at least one charge transport layer mixture, where at least one charge transport layer is from 1 to about 4 layers, from 1 to about 3 layers, 2 layers, or 1 layer. Examples of charge transport components or compounds present in an amount of, for example, from about 15 weight percent to about 70 weight percent, from about 15 weight percent to about 50 weight percent, from about 35 weight percent to about 45 weight percent, from about 40 weight percent to about 45 weight percent, or from about 35 weight percent to about 37 weight percent, based on the total solids, or the charge transport layer comprises a polycarbonate AP/charge transport compound/fluoropolymer/antioxidant in a weight ratio of about 57.8/33.9/7.3/1, a weight ratio of about 55.0/36.7/7.3/1, and the like, of the at least one charge transport layer are the compounds as illustrated in Xerox Corporation U.S. Pat. No. 8,470,466, the disclosure of which is totally incorporated herein by reference, and more specifically, aryl amine compounds or molecules selected from the group consisting of those represented by the following formulas/structures

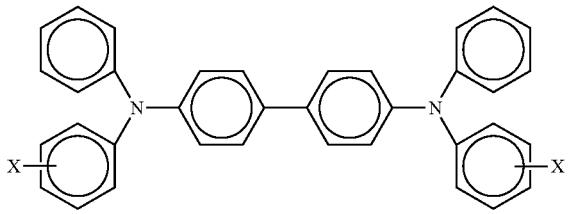

and

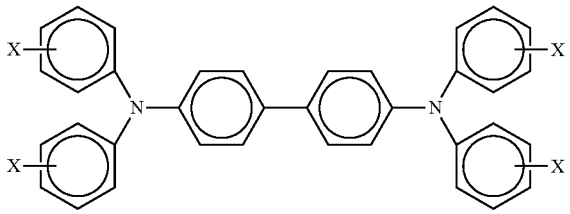

wherein X is a suitable hydrocarbon like alkyl, alkoxy, aryl, isomers thereof, and derivatives thereof like alkylaryl, alkoxyaryl, and arylalkyl; a halogen or mixtures of a suitable hydrocarbon and a halogen; and charge transport layer compounds as represented by the following formula/structure

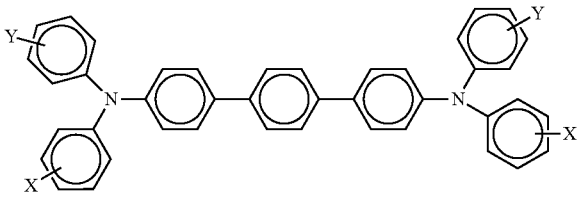

wherein X and Y are independently alkyl, alkoxy, aryl, a halogen, or mixtures thereof.

Alkyl and alkoxy for the photoconductor charge transport layer compounds illustrated herein contain, for example, from about 1 to about 25 carbon atoms, from about 1 to about 12 carbon atoms, or from about 1 to about 6 carbon atoms, such as methyl, ethyl, propyl, butyl, pentyl, hexyl, heptyl, octyl, nonyl, decyl, undecyl, dodecyl, pentadecyl, and the like, and the corresponding alkoxides. Aryl substituents for the charge transport layer compounds can contain from 6 to about 36, from 6 to about 24, from 6 to about 18, or from 6 to about 12 carbon atoms, such as phenyl, naphthyl, anthryl, and the like. Halogen substituents for the charge transport layer compounds include chloro, bromo, iodo, and fluoro. Substituted alkyls, substituted alkoxys, and substituted aryls can also be selected for the disclosed charge transport layer compounds.

In embodiments, the charge transport compound selected for the charge transport layer, or charge transport layers can be represented by the following formulas/structures

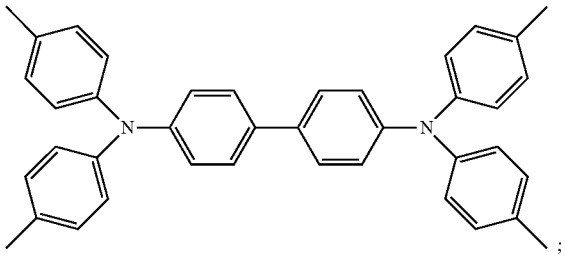
;
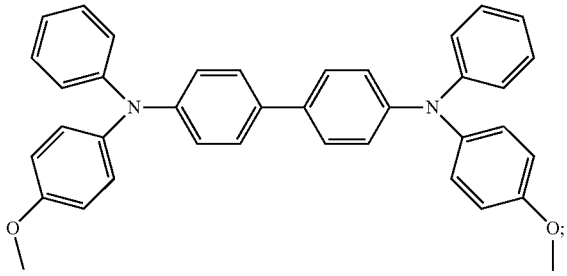
;
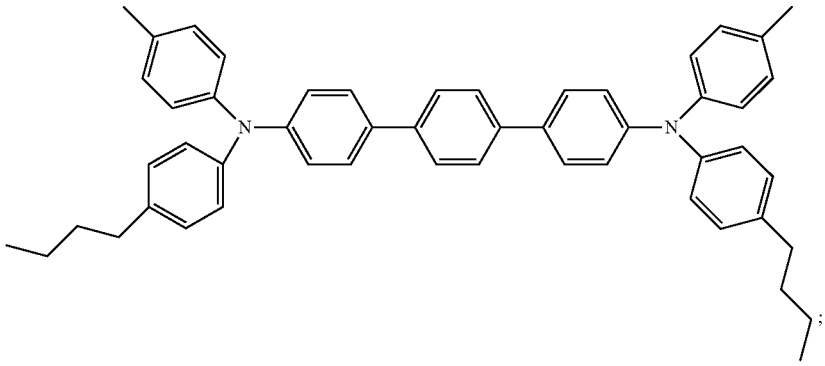
;
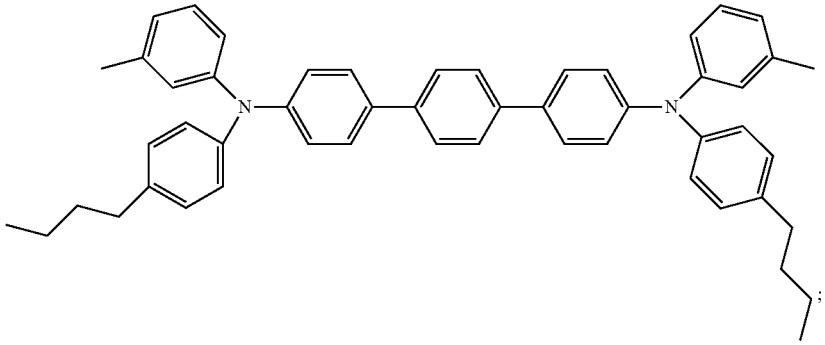
; and
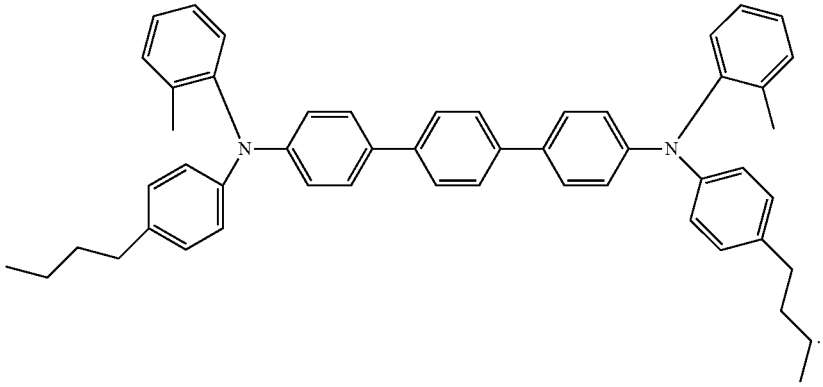
.

Examples of specific aryl amines present in at least one photoconductor charge transport layer include N,N,N',N'-tetra-p-tolyl-1,1'-biphenyl-4,4'-diamine, N,N'-diphenyl-N,N'-bis(alkylphenyl)-1,1'-biphenyl-4,4'-diamine, wherein alkyl is selected from the group consisting of methyl, ethyl, propyl, butyl, hexyl, heptyl, octyl, nonyl, decyl, undecyl, dodecyl, pentadecyl, and the like, N,N'-diphenyl-N,N'-bis(halophenyl)-1,1'-biphenyl-4,4'-diamine, wherein the halo substituent is chloro, N,N'-bis(4-butylphenyl)-N,N'-di-p-tolyl-[p-terphenyl]-4,4'-diamine, N,N'-bis(4-butylphenyl)-N,N'-di-m-tolyl-[p-terphenyl]-4,4'-diamine, N,N'-bis(4-butylphenyl)-N,N'-di-o-tolyl-[p-terphenyl]-4,4'-diamine, N,N'-bis(4-butylphenyl)-N,N'-bis-(4-isopropylphenyl)-[p-terphenyl]-4,4'-diamine, N,N'-bis(4-butylphenyl)-N,N'-bis-(2-ethyl-6-methylphenyl)-[p-terphenyl]-4,4'-diamine, N,N'-bis(4-butylphenyl)-N,N'-bis-(2,5-dimethylphenyl)-[p-terphenyl]-4,4'-diamine, N,N'-diphenyl-N,N'-bis(3-chlorophenyl)-[p-terphenyl]-4,4'-diamine, and the like; hydrazones such as N-phenyl-N-methyl-3-(9-ethyl)carbazyl hydrazone and 4-diethyl amino benzaldehyde-1,2-diphenyl hydrazine, or oxadiazoles such as 2,5-bis(4-N,N'-diethylaminophenyl)-1,2,4-oxadiazole, stilbenes, and the like.

Various processes may be used to mix, and thereafter apply the charge transport layer or layers to the photogenerating layer, such as spraying, dip coating, roll coating, wire wound rod coating, and the like. Drying of the deposited charge transport layer coating or plurality of coatings may be affected by any suitable conventional technique such as oven drying, infrared radiation drying, air drying, and the like.

The thickness of the charge transport layer or charge transport layers, in embodiments, is from about 5 microns to about 70 microns, from about 20 microns to about 65 microns, from about 15 microns to about 50 microns, or from about 10 microns to about 40 microns, but thicknesses outside this range may, in embodiments, also be selected. The charge transport layer should be an insulator to the extent that an electrostatic charge placed on the charge transport layer is not conducted in the absence of illumination at a rate sufficient to prevent formation and retention of an electrostatic latent image thereon. In general, the ratio of the thickness of the charge transport layer to the photogenerating layer can be, for example, from about 2:1 to 200:1, and in some instances about 400:1.

Optional Antioxidants

Examples of components or materials optionally incorporated into the charge transport layer or layers to, for example, enable excellent lateral charge migration (LCM) resistance include hindered phenolic antioxidants, such as tetrakis methylene(3,5-di-tert-butyl-4-hydroxy hydrocinnamate) methane (IRGANOX™ 1010, available from Ciba Specialty Chemical), butylated hydroxytoluene (BHT), and other hindered phenolic antioxidants including SUMILIZER™ BHT-R, MDP-S, BBM-S, WX-R, NW, BP-76, BP-101, GA-80, GM and GS (available from Sumitomo Chemical Co., Ltd.), IRGANOX™ 1035, 1076, 1098, 1135, 1141, 1222, 1330, 1425WL, 1520L, 245, 259, 3114, 3790, 5057 and 565 (available from Ciba Specialties Chemicals), and ADEKA STAB™ AO-20, AO-30, AO-40, AO-50, AO-60, AO-70, AO-80 and AO-330 (available from Asahi Denka Co., Ltd.); hindered amine antioxidants such as SANOL™ LS-2626, LS-765, LS-770 and LS-744 (available from SNKYO CO., Ltd.), TINUVIN™ 144 and 622LD (available from Ciba Specialties Chemicals), MARK™ LA57, LA67, LA62, LA68 and LA63 (available from Asahi Denka Co., Ltd.), and SUMILIZER™ TPS (available from Sumitomo Chemical Co., Ltd.); thioether antioxidants such as SUMILIZER™ TP-D (available from Sumitomo Chemical Co., Ltd); phosphite antioxidants such as MARK™ 2112, PEP-8, PEP-24G, PEP-36, 329K and HP-10 (available from Asahi Denka Co., Ltd.); other molecules such as bis(4-diethylamino-2-methylphenyl) phenylmethane (BDETPM), bis-[2-methyl-4-(N-2-hydroxyethyl-N-ethylaminophenyl)]-phenylmethane (DHTPM), and the like. The weight percent of the antioxidant in at least one of the charge transport layers is from about 0.1 weight percent to about 20 weight percent, from about 1 weight percent to about 10 weight percent, from about 1 weight percent to about 5 weight percent, or from about 0.5 weight percent to about 1.5 weight percent based on the solids present.

Optional Fluoropolymers

Optional fluoropolymers present in the at least one charge transport layer, and which fluoropolymers can contribute to the wear resistant properties of the photoconductors illustrated herein, include tetrafluoroethylene polymers (PTFE), trifluorochloroethylene polymers, hexafluoropropylene polymers, vinyl fluoride polymers, vinylidene fluoride polymers, difluorodichloroethylene polymers or copolymers thereof, perfluoroalkoxy polymers (PFA), copolymers of tetrafluoroethylene (TFE) and hexafluoropropylene (HFP), copolymers of hexafluoropropylene (HFP) and vinylidene fluoride (VDF or VF2), terpolymers of tetrafluoroethylene (TFE), vinylidene fluoride (VDF) and hexafluoropropylene (HFP), and tetrapolymers of tetrafluoroethylene (TFE), vinylidene fluoride (VF2), and hexafluoropropylene (HFP), and mixtures thereof.

The fluoropolymers are selected in various effective amounts, such as for example, from about 0.1 weight percent to about 20 weight percent, from about 1 weight percent to about 15 weight percent, from about 1 weight percent to about 8 weight percent, from about 5 weight percent to about 8 weight percent, or from about 2 weight percent to about 10 weight percent.

The photoconductor wear rates when selecting for the charge transport layer a mixture of a charge transport compound and the polycarbonate APs illustrated herein can, for example, be reduced by from about 5 percent to about 25 percent, and more specifically, from about 10 percent to about 20 percent as compared to a similar known photoconductor that is free of the charge transport layer polycarbonate AP. Also, the illustrated herein photoconductors can possess excellent cyclic stability, which refers, for example, to almost no or minimal change in a generated known photoinduced discharge curve (PIDC), especially no or minimal residual potential cycle up after a number of charge/discharge cycles of the photoconductor, for example about 100 kilocycles, or xerographic prints of, for example, from about 80 to about 200 kiloprints (Kp), and improved color print stability which refers, for example, to substantially no or minimal change in solid area density, especially in 60 percent halftone prints, and no or minimal random color variability from print to print after a number of xerographic prints, such as for example about 50 kiloprints.

Also included within the scope of the present disclosure are methods of imaging and printing with the photoconductor devices illustrated herein. These methods generally involve the formation of an electrostatic latent image on the imaging member, followed by developing the image with a toner composition comprised, for example, of thermoplastic resin, colorant, such as pigment, charge additive, and surface additive, reference U.S. Pat. Nos. 4,560,635 and 4,338,390, the disclosures of each of these patents being totally incorporated herein by reference, subsequently transferring the toner image to a suitable image receiving substrate, and permanently affixing the image thereto. In those environments wherein the photoconductor is to be used in a printing mode, the imaging method involves the same operation with the exception that exposure can be accomplished with a laser device or image bar. Processes of imaging, especially xerographic imaging and printing, including digital and/or color printing, are thus encompassed by the present disclosure.

The imaging members or photoconductors illustrated herein are, in embodiments, sensitive in the wavelength region of, for example, from about 400 to about 900 nanometers, and in particular from about 650 to about 850 nanometers, thus diode lasers can be selected as the light source. Moreover, the imaging members of this disclosure are useful in color xerographic applications, particularly high speed, for example at least 100 copies per minute, color copying and printing processes.

The thicknesses disclosed herein photoconductor layers can be measured by a number of known methods, such as by the use of a Permascope.

The following Examples are being submitted to illustrate embodiments of the present disclosure. Molecular weights were determined by Gel Permeation analysis. The weight ratios recited were determined primarily by the amount of components selected for the preparations indicated.

Comparative Example 1

On a 30 millimeter thick aluminum drum substrate, an undercoat layer was prepared and deposited thereon as follows.

Zirconium acetylacetonate tributoxide (35.5 parts), γ-aminopropyl triethoxysilane (4.8 parts), and poly(vinyl butyral) BM-S (2.5 parts) were dissolved in n-butanol (52.2 parts). The resulting solution was then coated by a dip coater on the above aluminum drum substrate, and the coating solution layer was preheated at 59° C. for 13 minutes, humidified at 58° C. (dew point=54° C.) for 17 minutes, and dried at 135° C. for 8 minutes. The thickness of the resulting undercoat layer was approximately 1.3 microns.

A photogenerating layer, 0.2 micron in thickness, comprising chlorogallium phthalocyanine (Type C) was deposited on the above undercoat layer. The photogenerating layer coating dispersion was prepared as follows: 2.7 grams of chlorogallium phthalocyanine (ClGaPc) Type C pigment was mixed with 2.3 grams of the polymeric binder (carboxyl-modified vinyl copolymer, VMCH, available from Dow Chemical Company), 15 grams of n-butyl acetate, and 30 grams of xylene. The resulting mixture was mixed in an Attritor mill with about 200 grams of 1 millimeter Hi-Bea borosilicate glass beads for about 3 hours. The dispersion mixture obtained was then filtered through a 20-micron nylon cloth filter, and the solids content of the resulting dispersion was diluted to about 6 weight percent.

Subsequently, a 32 micron thick charge transport layer was coated on top of the above photogenerating layer from a solution prepared by dissolving N,N'-diphenyl-N,N-bis(3-methylphenyl)-1,1'-biphenyl-4,4'-diamine (mTBD, 4.3 grams), and a film forming polymer binder of poly(4,4'-dihydroxy-diphenyl-1-1-cyclohexane carbonate), $M_w$=40,000, Tg=184° C., available as PCZ-400 from Mitsubishi Gas Chemical Company, Ltd. (5.7 grams), and of the following formula/structure

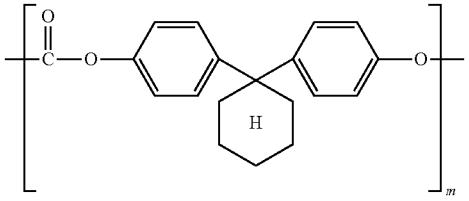

where m is about 150, 0.8 gram of polytetrafluoroethylene (PTFE), and 0.1 gram of a butylated hydroxytoluene (BHT), dissolved in a 70/30 solvent mixture of tetrahydrofuran (THF)/toluene, followed by drying in an oven at about 120° C. for about 40 minutes. The resulting charge transport layer PCZ-400/mTBD/PTFE/BHT weigh ratio was 52.3/39.4/7.3/1 in THF/toluene, 70/30, about 24 weight percent solids.

Example I

A photoconductor was prepared by repeating the process of Comparative Example 1 except that the 32 micron thick charge transport layer was coated on top of the photogenerating layer from a solution prepared from a mixture of N,N'-diphenyl-N, N-bis(3-methylphenyl)-1,1'-biphenyl-4,4'-diamine (mTBD), 33.9 weight percent, 57.8 weight percent of the polycarbonate AP obtained from Mitsubishi Gas Chemical Company and identified as FPC-0250, as represented by the following formula/structure

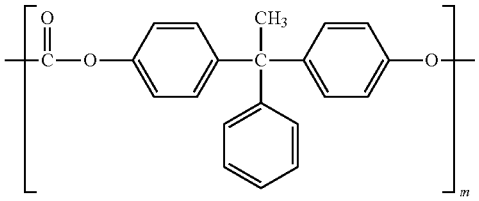

where m is about 170, the viscosity average molecular weight was 53,700 as determined by GPC analysis, and the Tg glass transition temperature was 196° C., 7.3 weight percent of the fluoropolymer polytetrafluoroethylene (PTFE), and 1 weight percent of butylated hydroxytoluene (BHT) dissolved in a solvent mixture of tetrahydrofuran/toluene 90/10. The 32 micron thick charge transport layer resulting was comprised of FPC-0250/mTBD/PTFE/BHT in a weight ratio of 57.8/33.9/7.3/1 in THF/toluene, 90/10, about 21 weight percent solids.

Example II

A photoconductor was prepared by repeating the process of Example I except that the 32 micron thick charge transport layer resulting was comprised of FPC-0250/mTBD/PTFE/BHT in a weight ratio of 55.0/36.7/7.3/1, and substantially similar results were achieved.

Example III

Two photoconductors are prepared by repeating the process of Example II except that for the polycarbonate AP formula m is about 170 for the first photoconductor and m is about 150 for the second photoconductor and there is obtained substantially similar results.

Electrical Property Testing

The above prepared photoconductors of Comparative Example 1 and Example I were tested in a scanner set to obtain photoinduced discharge cycles, sequenced at one charge-erase cycle followed by one charge-expose-erase cycle, wherein the light intensity was incrementally increased with cycling to produce a series of photoinduced discharge characteristic curves from which the photosensitivity and surface potentials at various exposure intensities were measured. Additional electrical characteristics were obtained by a series of charge-erase cycles with incrementing surface potentials to generate several voltage versus charge density curves. The scanner was equipped with a scorotron set to a constant voltage charging at various surface potentials. The above prepared photoconductors were tested at surface potentials of 700 volts with the exposure light intensity incrementally increased by means of regulating a series of neutral density filters; and the exposure light source was a 780 nanometer light emitting diode. The xerographic simulation was completed in an environmentally controlled light tight chamber at ambient conditions (40 percent relative humidity and 22° C.).

Substantially similar PIDCs were obtained for the three above prepared photoconductors of Comparative Example 1, Example I and Example II. Therefore, the incorporation of the polycarbonate AP in the charge transport layer of Example I did not adversely affect the electrical properties of this photoconductor.

Wear Testing

Print wear tests of the photoconductors of Comparative Example 1 and Example I were performed for 200 kiloprints in the Xerox Corporation PINOTR machine in J zone (10 percent humidity and 22° C.). The total thickness of each photoconductor was measured with a Permascope before and after the print wear test. The resulting differences in thickness were used to calculate wear rate (nanometers/kilocycle) of the photoconductors. The smaller the wear rate, the more wear resistant was the photoconductor.

There resulted an improved wear rate of 14 nm/kcycle for the Example I photoconductor versus a wear rate of 19 nm/kcycle for the Comparative Example 1 photoconductor, which represents a 29 percent wear rate improvement for the Example I photoconductor thus resulting in an increase in the life of this photoconductor. Thus, at a 10 percent life improvement for the disclosed photoconductors containing a polycarbonate AP containing charge transport layer there will result, it is believed, about a $5,000,000 cost savings over a four-year time period.

Generally, it is believed that there will be an increase of from about 5 to about 30 percent in the wear rate of the disclosed polycarbonate AP and a minimum wear value of from about 10 to about 20 nanometers per 1,000 xerographic cycles containing photoconductors versus the same photoconductors that include polycarbonate PCZ-400 [poly(4,4'-dihydroxy-diphenyl-1-1-cyclohexane carbonate)], in place of the polycarbonate AP, in the charge transport layer.

While not being desired to be limited by theory, it is believed that the disclosed photoconductor wear reduction results, such as up to an about 30 percent reduction in the wear rate, are related to the use of a tougher polycarbonate AP binder, for example, about a 12° C. higher glass transition temperature, (Tg) for the specific disclosed polycarbonate AP binder versus the polycarbonate PCZ-400, and a lower aryl amine compound amount, which is enabled since the disclosed polycarbonate AP is charge transporting, thus less aryl amine is needed for charge transport.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. A photoconductor comprising a photogenerating layer, and a charge transport layer, and wherein said charge transport layer contains a charge transport compound and a polycarbonate as represented by the following formula/structure

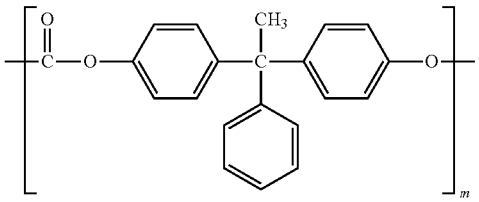

wherein m represents the number of repeating segments.

2. A photoconductor in accordance with claim 1 wherein m is from about 50 to about 500.

3. A photoconductor in accordance with claim 1 wherein said polycarbonate possesses a weight average molecular weight of from about 30,000 to about 100,000, and a number average molecular weight of from about 20,000 to about 70,000 as determined by GPC analysis.

4. A photoconductor in accordance with claim 1 further containing a supporting substrate, and situated between said substrate and said photogenerating layer a hole blocking layer, and situated between said photogenerating layer and said charge transport layer an adhesive layer.

5. A photoconductor in accordance with claim 1 further containing in the charge transport layer at least one of a hindered phenolic antioxidant and a fluoropolymer.

6. A photoconductor in accordance with claim 5 wherein said hindered phenolic antioxidant is a butylated hydroxytoluene.

7. A photoconductor in accordance with claim 5 wherein said fluoropolymer is selected from the group consisting of tetrafluoroethylene polymers, trifluorochloroethylene polymers, hexafluoropropylene polymers, vinyl fluoride polymers, vinylidene fluoride polymers, difluorodichloroethylene polymers or copolymers thereof, perfluoroalkoxy polymers, copolymers of tetrafluoroethylene and hexafluoropropylene, copolymers of hexafluoropropylene, and vinylidene fluoride, terpolymers of tetrafluoroethylene vinylidene fluoride and hexafluoropropylene, and tetrapolymers of tetrafluoroethylene vinylidene fluoride and hexafluoropropylene, and mixtures thereof.

8. A photoconductor in accordance with claim 5 wherein said fluoropolymer is a polytetrafluoroethylene.

9. A photoconductor in accordance with claim 1 wherein said charge transport compound is represented by at least one of

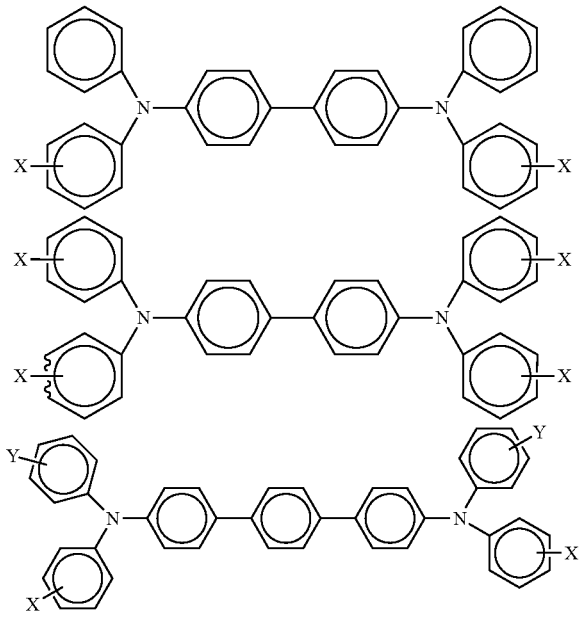

and

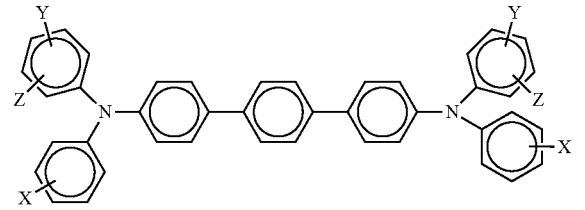

wherein X, Y, and Z are independently selected from the group consisting of alkyl, alkoxy, aryl, halogen, and mixtures thereof.

10. A photoconductor in accordance with claim 1 wherein said charge transport compound is represented by the following formula/structure

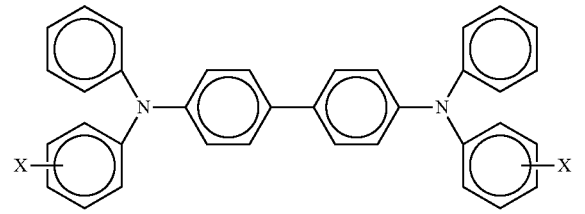

wherein x is alkyl, halogen, or mixtures thereof.

11. A photoconductor in accordance with claim 1 wherein said charge transport compound is selected from the group consisting of N,N'-bis(methylphenyl)-1,1-biphenyl-4,4'-diamine, tetra-p-tolyl-biphenyl-4,4'-diamine, N,N'-diphenyl-N,N'-bis(4-methoxyphenyl)-1,1-biphenyl-4,4'-diamine, N,N'-bis(4-butylphenyl)-N,N'-di-p-tolyl-[p-terphenyl]-4,4'-diamine, N,N'-bis(4-butylphenyl)-N,N'-di-m-tolyl-[p-terphenyl]-4,4'-diamine, N,N'-bis(4-butylphenyl)-N,N'-di-o-tolyl-[p-terphenyl]-4,4'-diamine, N,N'-bis(4-butylphenyl)-N,N'-bis-(4-isopropylphenyl)-[p-terphenyl]-4,4'-diamine, N,N'-bis(4-butylphenyl)-N,N'-bis-(2-ethyl-6-methylphenyl)-[p-terphenyl]-4,4'-diamine, N,N'-bis(4-butylphenyl)-N,N'-bis-(2,5-dimethylphenyl)-[p-terphenyl]-4,4'-diamine, and N,N'-diphenyl-N,N'-bis(3-chlorophenyl)-[p-terphenyl]-4,4'-diamine.

12. A photoconductor in accordance with claim 11 wherein said charge transport layer further includes an antioxidant and a fluoropolymer.

13. A photoconductor in accordance with claim 1 wherein said photogenerating layer is comprised of at least one photogenerating pigment.

14. A photoconductor in accordance with claim 1 wherein said photogenerating layer is comprised of at least one of a titanyl phthalocyanine, a hydroxygallium phthalocyanine, a halogallium phthalocyanine, a bisperylene, and mixtures thereof.

15. A photoconductor comprising in sequence a supporting substrate, a hole blocking layer thereover, a photogenerating layer, and a charge transport layer comprised of a mixture of an aryl amine hole transport compound, an antioxidant, a fluoropolymer, and a polycarbonate as represented by the following formula/structure

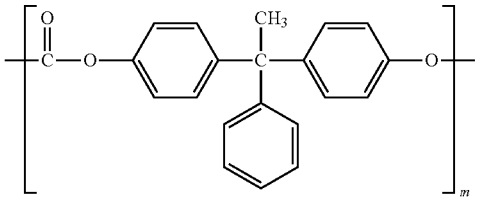

wherein m represents the number of repeating segments or groups.

16. A photoconductor in accordance with claim 15 wherein the value of m is from about 50 to about 500, said aryl amine is a charge transport compound selected from the group consisting of N,N'-bis(methylphenyl)-1,1-biphenyl-4,4'-diamine, tetra-p-tolyl-biphenyl-4,4'-diamine, N,N'-diphenyl-N,N'-bis(4-methoxyphenyl)-1,1-biphenyl-4,4'-diamine, N,N'-bis(4-butylphenyl)-N,N'-di-p-tolyl-[p-terphenyl]-4,4'-diamine, N,N'-bis(4-butylphenyl)-N,N'-di-m-tolyl-[p-terphenyl]-4,4'-diamine, N,N'-bis(4-butylphenyl)-N,N'-di-o-tolyl-[p-terphenyl]-4,4'-diamine, N,N'-bis(4-butylphenyl)-N,N'-bis-(4-isopropylphenyl)-[p-terphenyl]-4,4'-diamine, N,N'-bis(4-butylphenyl)-N,N'-bis-(2-ethyl-6-methylphenyl)-[p-terphenyl]-4,4'-diamine, N,N'-bis(4-butylphenyl)-N,N'-bis-(2,5-dimethylphenyl)-[p-terphenyl]-4,4'-diamine, and N,N'-diphenyl-N,N'-bis(3-chlorophenyl)-[p-terphenyl]-4,4'-diamine, said antioxidant is a hindered phenolic component, and wherein said photoconductor has minimal wear characteristics of from about 10 to about 20 nanometers per kilocycle.

17. A photoconductor in accordance with claim 15 wherein said hole blocking layer is comprised of an aminosilane of at least one of 3-aminopropyl triethoxysilane, N,N-dimethyl-3-aminopropyl triethoxysilane, N-phenylaminopropyl trimethoxysilane, triethoxysilylpropylethylene diamine, trimethoxysilylpropylethylene diamine, trimethoxysilylpropyldiethylene triamine, N-aminoethyl-3-aminopropyl trimethoxysilane, N-2-aminoethyl-3-aminopropyl trimethoxysilane, N-2-aminoethyl-3-aminopropyl tris(ethylethoxy)silane, p-aminophenyl trimethoxysilane, N,N'-dimethyl-3-aminopropyl triethoxysilane, 3-aminopropylmethyl diethoxysilane, 3-aminopropyl trimethoxysilane, N-methylaminopropyl triethoxysilane, methyl[2-(3-trimethoxysilylpropylamino)ethylamino]-3-proprionate, (N,N'-dimethyl 3-amino)propyl triethoxysilane, N,N-dimethylaminophenyl triethoxysilane, trimethoxysilyl propyldiethylene triamine, and mixtures thereof.

18. A photoconductor comprising a supporting substrate, an optional hole blocking layer thereover, a photogenerating layer, and a hole transport layer comprised of a mixture of a hole transport compound, an optional fluoropolymer, an optional antioxidant, and a polycarbonate as encompassed by the following formula/structure, and which photoconductor possesses a wear rate reduction of from about 5 percent to about 25 percent

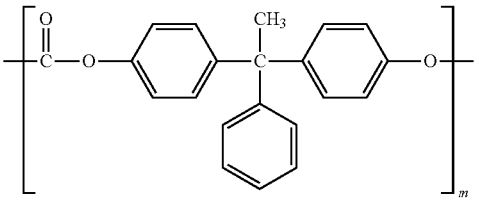

wherein m represents the number of repeating segments or groups.

19. A photoconductor in accordance with claim 18 wherein said antioxidant and said fluoropolymer are present.

20. A photoconductor in accordance with claim 18 wherein said wear rate reduction is expressed as a wear rate of from about 10 to about 20 nanometers per kilocycle.

21. A photoconductor in accordance with claim 1 wherein said photoconductor has minimal wear characteristics of from about 10 to about 20 nanometers per kilocycle.

22. A photoconductor in accordance with claim 1 wherein said photoconductor possesses a wear rate reduction of from about 10 percent to about 25 percent.

23. A photoconductor in accordance with claim 15 wherein said photoconductor possesses a wear rate reduction of from about 10 percent to about 25 percent.

* * * * *